US006461563B1

(12) United States Patent
Lim et al.

(10) Patent No.: US 6,461,563 B1
(45) Date of Patent: Oct. 8, 2002

(54) METHOD TO FORM MULTI-MATERIAL COMPONENTS

(75) Inventors: Kay-Leong Lim, Singapore (SG); Lye-King Tan, Singapore (SG); Eng-Seng Tan, Singapore (SG); Robin Baumgartner, Singapore (SG)

(73) Assignee: Advanced Materials Technologies Pte. Ltd., Singapore (SG)

( * ) Notice: Subject to any disclaimer, the term of this patent is extended or adjusted under 35 U.S.C. 154(b) by 8 days.

(21) Appl. No.: 09/733,527

(22) Filed: Dec. 11, 2000

(51) Int. Cl.[7] ..... B22F 7/02
(52) U.S. Cl. ..... 419/5; 419/6; 428/548
(58) Field of Search ..... 419/5, 6; 428/548

(56) References Cited

U.S. PATENT DOCUMENTS 4,602,952 A * 7/1986 Greene et al. ..... 75/228
4,602,956 A * 7/1986 Patlow et al. ..... 75/235
5,393,484 A * 2/1995 Seyama et al. ..... 419/37
6,120,727 A * 9/2000 Asaka et al. ..... 419/6

FOREIGN PATENT DOCUMENTS

JP 3-232906 * 10/1991
JP 4-34604 * 12/1992
JP 7-90312 * 4/1995

OTHER PUBLICATIONS

"Composite parts by powder injecting molding", Advances in powder metallurgy and particulate materials, vol. 5, pp. 19–171 to 19–178, 1996, Andrea Pest et al.

* cited by examiner

*Primary Examiner*—Ngoclan Mai
(74) *Attorney, Agent, or Firm*—George O. Saile; Stephen B. Ackerman

(57) ABSTRACT

The invention shows how powder injection molding may be used to form a continuous body having multiple parts, each of which has different physical properties such as magnetic characteristics or hardness. This is accomplished through careful control of the relative shrinkage rates of these various parts. Additionally, care is taken to ensure that only certain selected physical properties are allowed to differ between the parts while others may be altered through relatively small changes in the composition of the feedstocks used. An additional application of the present invention is a process for forming, in a single integrated operation, an object that is contained within an enclosure while not being attached to said enclosure. This is accomplished by causing the shrinkage rate of the object to be substantially greater than that of the enclosure. As a result, after sintering, the object is found to have detached itself from the enclosure and is free to move around therein. Several examples of structures formed using these processes are presented.

26 Claims, 4 Drawing Sheets

METHOD TO FORM MULTI-MATERIAL COMPONENTS

FIELD OF THE INVENTION

The invention relates to the general field of powder metallurgy and compression molding with particular reference to forming complex structures.

BACKGROUND OF THE INVENTION

The production of metal or ceramic components using powder injection molding (PIM) processes is well known. The powder is mixed with the binder to produce a mixture that can be molded into the desired part. The binder must have suitable flow properties to permit injection into a tooling cavity and forming of the part. The molded part is usually an oversized replica of the final part. It is subjected to debinding where the binder is removed without disturbing the powder orientation. After the binder is removed, the part is subjected to sintering process that results in part densification to a desired level.

The parts produced by PIM may be complex in geometry. They also tend to be made of a single material. For example, an orthodontic bracket can be made of 316L stainless steel using PIM technology.

There is, however, a need for objects, formed by PIM, that contain multiple parts, each of which is a different material whose properties differ from those of its immediate neighbors. The prior art practice has been to form each such part separately and to then combine them in the finished product using costly welding operations or mechanical fitting methods to bond these different parts of different materials together.

The basic approach that the present invention takes to solving this problem is schematically illustrated in FIGS. 1*a* and 1*b*. In FIG. 1*a*, 11 and 12 represent two green objects having different physical properties and formed by PIM. FIG. 1*b* shows the same two objects, after sintering, joined to form a single object. In the prior art, the interface 13 between 11 and 12 was usually a weld (i.e. a different material from either 11 or 12). Alternately, a simple press fit between the 11 and 12 might have sufficed so that the final object was not a continuous body.

An obvious improvement over welding or similar approaches would appear to have been to sinter 11 and 12 while they were in contact with one another. In practice, such an approach has usually not succeeded due to a failure of the two parts to properly bond during sintering. The present invention teaches how problems of this sort can be overcome so that different parts made of materials having different physical properties can be integrated to form a single continuous body.

A routine search of the prior art was performed with the following reference of interest being found: In "Composite parts by powder injection molding", Advances in powder metallurgy and particulate materials, vol. 5, pp 19–171 to 19–178, 1996, Andrea Pest et al. discuss the problems of sintering together parts that comprise more than one material. They show that control of shrinkage during sintering is important but other factors (to be discussed below) are not mentioned.

SUMMARY OF THE INVENTION

It has been an object of the present invention to provide a process for the formation of a continuous body having multiple parts, each with different physical properties.

This object have been achieved by using powder injection molding together with careful control of the relative shrinkage rates of the various parts. Additionally, care is taken to ensure that only certain selected physical properties are allowed to differ between the parts while others may be altered through relatively small changes in the composition of the feedstocks used.

Another object has been to provide a process for forming, in a single integrated operation, an object that is contained within an enclosure while not being attached to said enclosure.

This object has been achieved by means of powder injection molding wherein the shrinkage rate of the object is caused to be substantially greater than that of the enclosure. As a result, after sintering, the object is found to have detached itself from the enclosure, being free to move around therein.

DESCRIPTION OF THE PREFERRED EMBODIMENTS

Figure 1A:
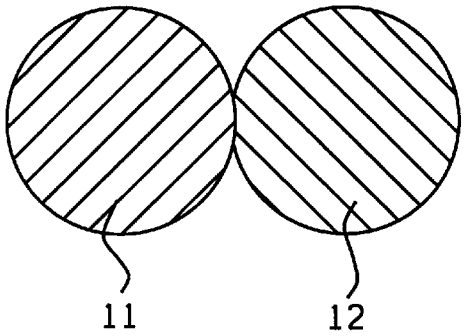
FIG. 1a Prior Art
FIGS. 1*a* and 1*b* illustrate two contiguous parts, made of different materials, before and after sintering, respectively.
Figure 1B:
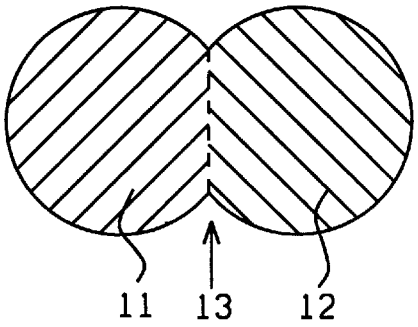
FIG. 1b Prior Art

This invention describes a novel method of manufacturing multi-material components using powder injection molding processes. Injection molding of different-material articles is an economically attractive method for manufacturing finished articles of commercial values due to its high production capacity and net shape capability.

As is well known to those skilled in the art, the basic procedure for forming sintered articles is to first provide the required material in powdered form. This powder is then mixed with lubricants and binders to form a feedstock. Essentially any organic material which will decompose under elevated temperatures without leaving an undesired residue that will be detrimental to the properties of the metal articles, can be used. Preferred materials are various organic polymers such as stearic acids, micropulvar wax, paraffin wax and polyethylene. Stearic acid serves as a lubricant while all the other materials may be used as binders. The amount and nature of the binder/lubricant that is added to the powder will determine the viscosity of the feedstock and the amount of shrinkage that will occur during sintering.

Once the feedstock has been prepared, it is injected into a suitable mold. The resulting 'green' object is then ejected from the mold. It has sufficient mechanical strength to retain its shape during handling while the binder is removed by heating or through use of a solvent. The resulting 'skeleton' is then placed in a sintering furnace and, typically, heated at a temperature between about 1,200 and 1,350° C. for between about 30 and 180 minutes in hydrogen or vacuum.

As already noted, attempts to form single objects containing parts made of different materials have usually been limited to forming the parts separately and joining them together later. This has been because green parts made of different materials could not be relied upon to always bond properly during the sintering process.

The present invention teaches that failure to bond during sintering comes about because (i) the shrinkage of the parts differs one from the other by more than a critical amount and (ii) certain physical properties differ between the parts.

By the same token, certain other physical properties may be quite different between the parts with little or no effect on bonding.

Physical properties that need to be the same or similar if good bonding is to occur include (but are not limited to) coefficient of thermal expansion and melting point, while properties that may differ without affecting bonding include (but are not limited to) electrical conductivity, magnetic coercivity, dielectric constant, thermal conductivity, Young's modulus, hardness, and reflectivity.

In cases that are well suited to the practice of the present invention it will not be necessary for the composition of two powders to vary one from another by very much. Typically, the two mixtures would differ in chemical composition by less than about 25 percent of all ingredients.

Additionally, it is important that the powders that were used to form the feedstocks of the two parts share similar characteristics such as particle shape, texture, and size distribution. The tap densities of the two powders should not differ by more than about 30% while the mean particle size for both powders should be in the range of about 1 to 40 microns.

As an example, if one part needs to be soft material (say low carbon iron), and another part is to be a hard material such as high carbon iron, then alloying the low carbon iron with specific amount of carbon will enhance hardenability and meet the requirement of high carbon iron. In so doing, both powders are still similar and have similar shrinkage rates. This will give rise to good bonding between the two materials while having different properties.

Similarly, if one material is low carbon iron and another is stainless steel, then blending the master alloy of the stainless steel with an appropriate amount of iron powder to form the required stainless steel composition can bring the overall powder characteristics closer to each other. For example, if two materials are 316L Stainless Steel and low carbon iron. Then the approach is to blend one third of master alloy of 316L with two-third of low carbon iron to form the actual 316L composition.

Note that molding of a two-material article can be achieved in one tooling of one or several cavities in a single barrel machine of one material first. The molded article is transferred to another tooling in another single barrel machine of another material to form the desired article though a manual pick-and-place operation or by using a robotic arm. The molding process can also be carried out on a twin-barrel injection machine to mold a complete article with two materials within a single tooling.

1st Embodiment

Figure 2A:
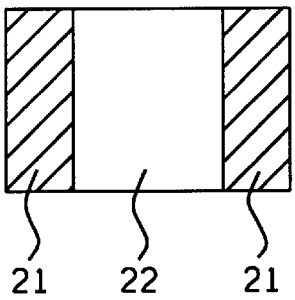
FIGS. 2*a* and 2*b* show steps in the process of the present invention.
Figure 2B:
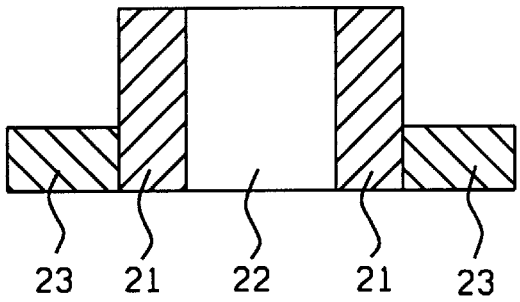

We will illustrate this embodiment through reference to FIGS. 2*a* and 2*b*, but it should be understood that the process that we disclose is independent of the shape, form, size, etc. of the structure that is formed.

The first step is the preparation of a first feedstock. This is accomplished by adding lubricants and binders (as discussed earlier) to a mixture of powders. The latter consist, by weight, of about 0.05 percent carbon, about 15 percent chromium, about 0.5 percent manganese, about 0.5 percent silicon, about 0.3 percent niobium, about 4 percent nickel, and about 80 percent iron. Using a suitable mold, this first feedstock is compression molded to form first green part 21, as shown in FIG. 2*a*. This happens to have a cylindrical shape with 22 representing the hollow center.

Then, a second feedstock is formed by adding lubricants and binders to a mixture of powders consisting, by weight, of about 0.05 percent carbon, about 15 percent chromium, about 0.5 percent manganese, about 0.5 percent silicon, about 0.3 percent niobium, about 14 percent nickel, and about 70 percent iron. It is important that the lubricants and binders are present in concentrations that ensure that, after sintering, the difference in the amounts the two feedstocks shrink is less than about 1% of total shrinkage experienced by either one.

We note here that although the two feedstocks have the same composition except that 10% of iron has been replaced by an additional 10% of nickel. This relatively small change in chemical composition leaves the key physical properties associated with successful sintering unchanged but introduces a significant change in the magnetic properties.

Next, first green part 21 is transferred to a second mold into which is then injected a sufficient quantity of the second feedstock to complete the structure shown in FIG. 2*b* through the placement of 23 around ring 21.

Once the final 'compound' green object has been formed, all lubricants/binders are removed, in ways discussed earlier, resulting in a powder skeleton which can then be sintered so that it becomes a continuous body having both magnetic and non-magnetic parts. Because of the compositions of the originals powders from which the two feedstocks were formed, part 21 of FIG. 2*b* that derived from the first feedstock is magnetic while part 23 that derived from the second feedstock is not. In this particular example the magnetic part has a maximum permeability ($\mu$ max) between about 800 and 1,500.

Figure 3:
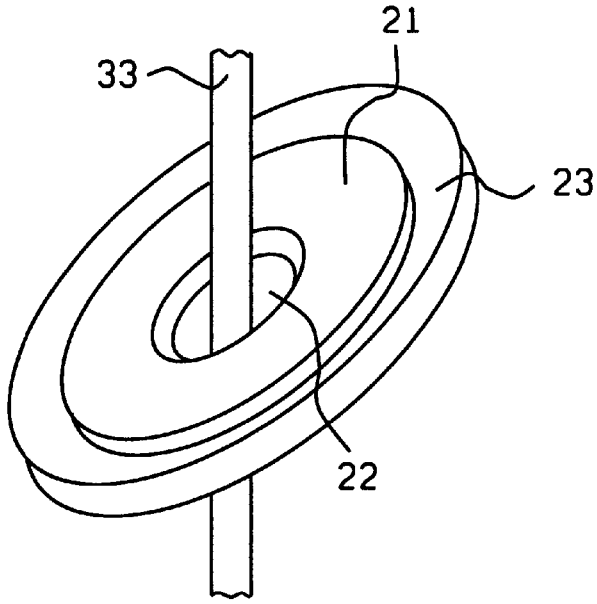
FIG. 3 is an isometric view of the object seen in cross-section in FIG. 2*b*.

In FIG. 3 we show an isometric view of the object seen in FIG. 2*b* with the addition of rod 33 which is free to move back and forth through hole 22. If rod 33 is magnetic, its position relative to hole 22 could be controlled by means of an applied magnetic field generated by an external coil (not shown). Since part 21 is of a magnetic material, it will act as a core for concentrating this applied field. Rod 33 could be formed separately or it could be formed in situ as part of an integrated manufacturing process, using the method to be described later under the second embodiment.

Figure 4:
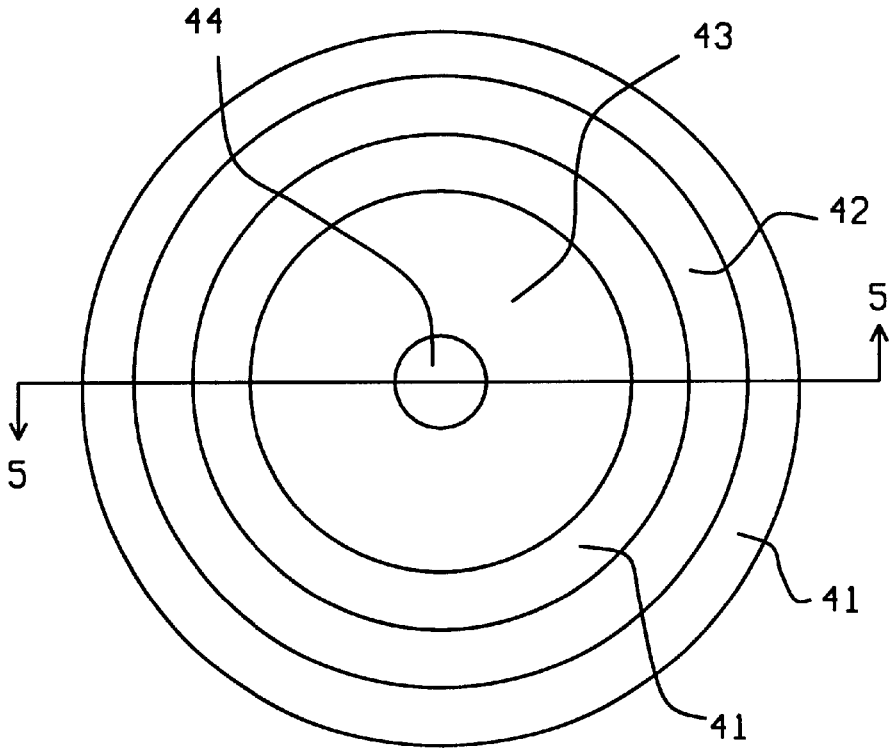
FIG. 4 is a plan view of an object that has three parts, one non-magnetic, one a hard magnet, and one a soft magnet.

As already implied, the formation of a continuous body having multiple parts, each with different properties, need not be limited to two such parts. In FIG. 4 we show a plan view of an object having three parts, each with different properties. All parts are concentric rings. At the center of the structure is opening 44 that is surrounded by inner ring 43. Ring 43 is non-magnetic. It is surrounded by ring 41 that is a soft magnet. Its inner portion has the same thickness as ring 43. Ring 41 also has an outer portion that is thicker than ring 43, causing it to have an inside sidewall 52 which can be seen in the cross-sectional view shown in FIG. 5. Aligned with, and touching, this sidewall is intermediate ring 42 which is a hard magnet. In this context, the term soft magnet refers to a material having a low coercivity with high magnetic saturation while the term hard magnet refers to a material having a high coercivity.

Figure 5:
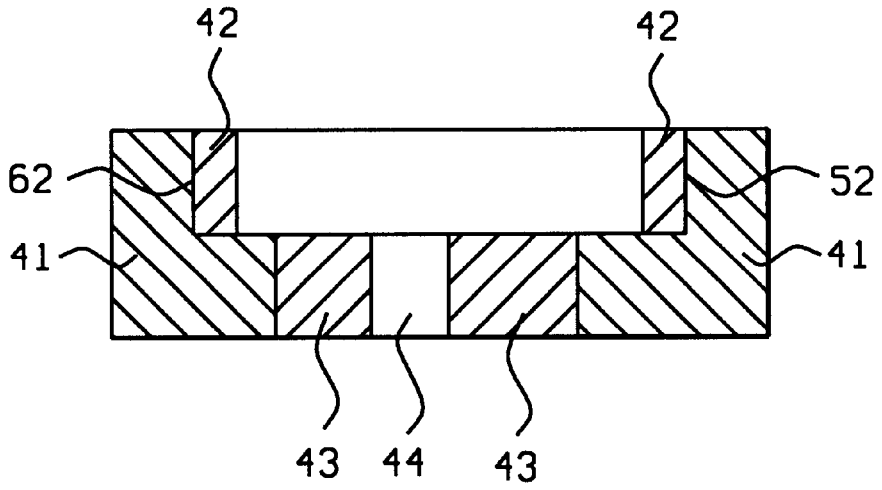
FIG. 5 is a cross-section taken through the center of FIG. 4.

The structure seen in FIGS. 4 and 5 is made by fitting hard magnet 42 (made separately) into the integral part after 41 and 43 have been formed. The reason for adding a ring of magnetically hard material to a structure that is similar to that seen in FIG. 3 is to be able to provide a permanent bias for the applied external magnetic field.

2nd Embodiment

In this embodiment we disclose a process for forming, in a single integrated operation, one object that is enclosed by another with the inner object not being attached to the outer object. As for the first embodiment, the process is illustrated through an example but it will be understood that it is applicable to any shaped object inside any shaped enclosure.

Figure 6:
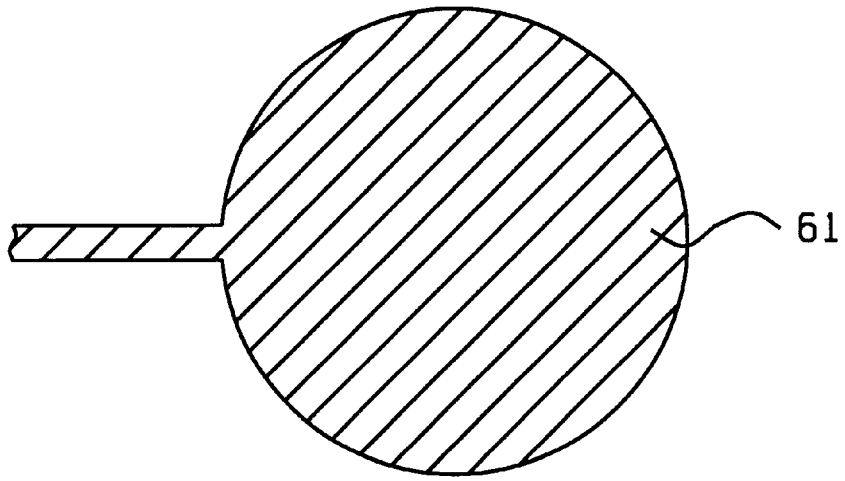
FIGS. 6 to 8 illustrate steps in the process of the second embodiment wherein an object is formed inside an enclosure.

In FIG. 6 we show, in schematic representation, an object that has been formed through PIM. As part of the process for its formation, the quantity and quality of the binders/lubricants were chosen so that, after sintering, the green form of 61 would shrink by a relatively large amount (typically between about 20 and 50%).

Figure 7:
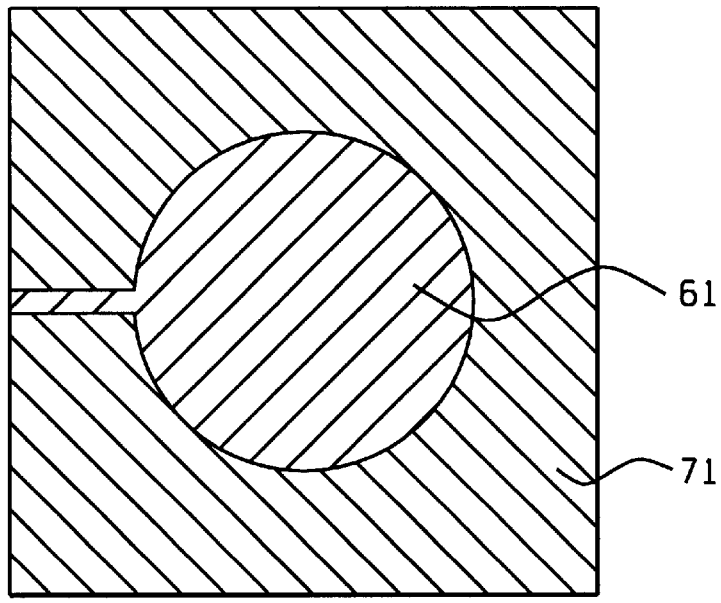

Referring now to FIG. 7 we show enclosure 71 that has been formed by fully surrounding 61 with material from a second feedstock for which binders/lubricants were chosen so that, after sintering, the green form of 71 would shrink by a relatively small amount (typically between about 10 and 20%). Regardless of the absolute shrinkages associated with parts 61 and 71, it is a key requirement of the process that the difference between the two shrinkage rates be at least 10%.

Figure 8:
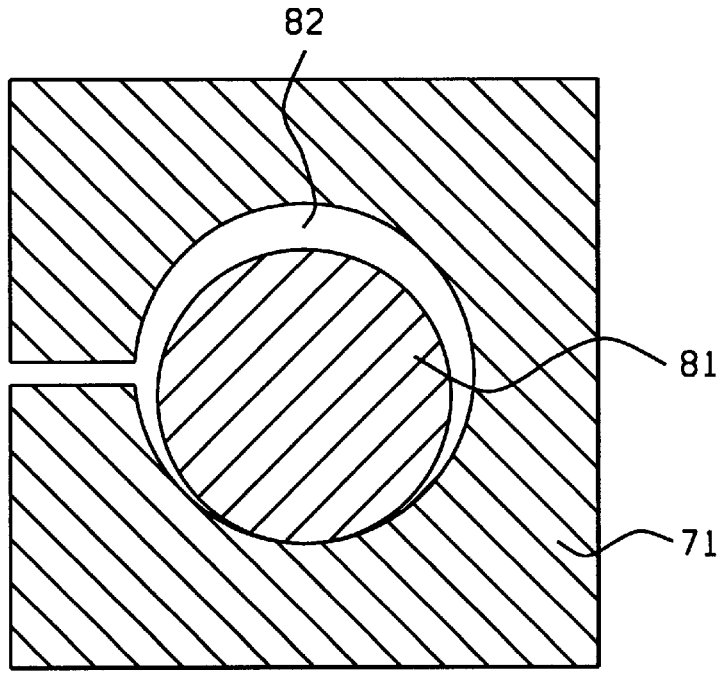

After the removal of all lubricants and binders from the object seen in FIG. 7, the resulting powder skeleton is sintered (between about 1,200 and 1,380° C. for between about 30 and 180 minutes in vacuum or in hydrogen for ferrous alloy steels. Because of the larger shrinkage rate of 61 relative to 71, the structure after sintering has the appearance shown in FIG. 8 where part 81 (originally 61) is seen to have become detached from 71 enabling it to move freely inside interior space 82. An example of a structure of this type is an electrostatic motor (unfinished at this stage) in which 71 will ultimately serve as the stator and 81 as the rotor. In the prior art, such structures had to be made using a sacrificial layer to effect the detachment of 81 from 71.

While the invention has been particularly shown and described with reference to the preferred embodiments thereof, it will be understood by those skilled in the art that various changes in form and details may be made without departing from the spirit and scope of the invention.

What is claimed is:

1. A process for manufacturing a compound sintered article, comprising:

providing a first mixture of powdered materials, said mixture having, after sintering, a first set of physical properties;

providing a second mixture of powdered materials, said mixture having, after sintering, a second set of physical properties that are the same as said first set of physical properties with one, and only one, exception;

adding lubricants and binders to said first and second mixtures to form first and second feedstocks such that the amount that said feedstocks will shrink after sintering differs one from the other by less than about 1%;

using a first mold, compression molding the first feedstock to form a first green part;

transferring said first green part to a second mold and then injecting into said second mold a quantity of the second feedstock sufficient to form a compound green part;

removing all lubricants and binders from the compound green part to form a powder skeleton; and sintering the powder skeleton to form said compound sintered article.

2. The process described in claim 1 wherein the set of physical properties further comprises two or more properties selected from the group consisting of coefficient of thermal expansion, melting point, electrical conductivity, magnetic coercivity, dielectric constant, thermal conductivity, Young's modulus, hardness, and reflectivity.

3. The process described in claim 2 wherein said physical property that is an exception is selected from the group consisting of electrical conductivity, magnetic coercivity, dielectric constant, hardness, and reflectivity.

4. The process described in claim 1 wherein the first and second mixtures differ in chemical composition by less than about 25 percent of all ingredients.

5. The process described in claim 1 wherein the step of sintering further comprises heating at a temperature between about 1,200 and 1,380° C. for between about 30 and 180 minutes in vacuum or hydrogen.

6. A process for manufacturing a continuous body having magnetic and non-magnetic parts, comprising:

forming a first feedstock by adding lubricants and binders to a mixture of powders consisting, by weight, of:

about 0.05 percent carbon, about 15 percent chromium, about 0.5 percent manganese, about 0.5 percent silicon, about 0.3 percent niobium, about 4 percent nickel, and about 80 percent iron;

forming a second feedstock by adding lubricants and binders to a mixture of powders consisting, by weight, of:

about 0.05 percent carbon, about 15 percent chromium, about 0.5 percent manganese, about 0.5 percent silicon, about 0.3 percent niobium, about 14 percent nickel, and about 70 percent iron whereby said lubricants and binders are present in concentrations such that the amount that said feedstocks will shrink after sintering differs one from the other by less than about 1%;

using a first mold, compression molding the first feedstock to form a first green part;

transferring said first green part to a second mold and then injecting into said second mold a quantity of the second feedstock sufficient to form a compound green part;

removing all lubricants and binders from the compound green part to form a powder skeleton; and sintering the powder skeleton to form said continuous body wherein parts of the body that derive from said first feedstock are magnetic and parts of the body that derive from said second feedstock are non-magnetic.

7. The process described in claim 6 wherein the magnetic parts have a maximum permeability between about 800 and 1,500.

8. The process described in claim 6 wherein the step of sintering further comprises heating at a temperature between about 1,200 and 1,380° C. for between about 30 and 180 minutes in vacuum or hydrogen.

9. A process for forming an object that is within, and detached from, an enclosure, comprising:

providing first and second mixtures of powdered materials;

adding lubricants and binders to said first and second mixtures to form first and second feedstocks such that the amount that said first feedstock will shrink after sintering exceeds the amount that the second feedstock will shrink after sintering by at least 10%;

using a first mold, compression molding the first feedstock to form the object in its green state, transferring the green object to a second mold and then injecting into said second mold a quantity of the second feedstock sufficient to form the enclosure around the object;

removing all lubricants and binders thereby forming a powder skeleton; and sintering the powder skeleton whereby said object becomes detached from said enclosure due to the greater amount of shrinkage undergone by the object.

10. The process described in claim 9 wherein the step of sintering further comprises heating at a temperature between about 1,200 and 1,380° C. for between about 30 and 180 minutes in vacuum or hydrogen.

11. A structure comprising:

a continuous body, having a first part possessing a first set of physical properties; and a second part having a second set of physical properties that are the same as said first set of physical properties with one, and only one, exception.

12. The structure described in claim 11 wherein the set of physical properties further comprises two or more properties selected from the group consisting of coefficient of thermal expansion, melting point, electrical conductivity, magnetic coercivity, dielectric constant, thermal conductivity, Young's modulus, hardness, and reflectivity.

13. The structure described in claim 12 wherein said physical property that is an exception is selected from the group consisting of electrical conductivity, magnetic coercivity, dielectric constant, hardness, and reflectivity.

14. The structure described in claim 11 wherein the first and second parts differ in chemical composition by less than about 25 percent of all ingredients.

15. A structure comprising:

a continuous body having a first part that is magnetic, consisting, by weight, of:

about 0.05 percent carbon, about 15 percent chromium, about 0.5 percent manganese, about 0.5 percent silicon, about 0.3 percent niobium, about 4 percent nickel, and about 80 percent iron;

a second part that is non-magnetic, consisting, by weight, of:

about 0.05 percent carbon, about 15 percent chromium, about 0.5 percent manganese, about 0.5 percent silicon, about 0.3 percent niobium, about 14 percent nickel 70 percent iron; and wherein no materials other than said first and second parts are present.

16. The structure described in claim 15 wherein the first part has a maximum permeability between about 800 and 1,500.

17. A disk structure having a center, comprising:

an outer ring part that is a soft magnet;

an intermediate ring part that is a hard magnet;

an inner ring part that is non-magnetic;

an opening symmetrically disposed around the center; and wherein all three rings form a continuous body, there being no materials present other than the three rings.

18. The structure described in claim 17 further comprising a moveable rod of magnetic material disposed so as to pass through said opening.

19. A process for manufacturing a compound sintered article, comprising:

providing a first mixture of powdered materials, said mixture having, after sintering, a first set of physical properties;

providing a second mixture of powdered materials, said mixture having, after sintering, a second set of physical properties that are the same as said first set of physical properties with two or more exceptions;

ensuring that said first and second mixtures differ in chemical composition by less than about 25 percent of all ingredients;

adding lubricants and binders to said first and second mixtures to form first and second feedstocks such that the amount that said feedstocks will shrink after sintering differs one from the other by less than about 1%;

using a first mold, compression molding the first feedstock to form a first green part;

transferring said first green part to a second mold and then injecting into said second mold a quantity of the second feedstock sufficient to form a compound green part;

removing all lubricants and binders from the compound green part to form a powder skeleton; and sintering the powder skeleton to form said compound sintered article.

20. The process described in claim 19 wherein the set of physical properties further comprises two or more properties selected from the group consisting of coefficient of thermal expansion, melting point, electrical conductivity, magnetic coercivity, dielectric constant, thermal conductivity, Young's modulus, hardness, and reflectivity.

21. The process described in claim 20 wherein said physical properties that are exceptions are selected from the group consisting of electrical conductivity, magnetic coercivity, dielectric constant, hardness, and reflectivity.

22. The process described in claim 19 wherein the step of sintering further comprises heating at a temperature between about 1,200 and 1,380° C. for between about 30 and 180 minutes in vacuum or hydrogen.

23. A structure comprising:

a continuous body, having a first part possessing a first set of physical properties;

a second part having a second set of physical properties that are the same as said first set of physical properties with two or more exceptions; and said first and second parts differing in chemical composition by less than about 25 percent of all ingredients.

24. The structure described in claim 23 wherein the set of physical properties further comprises two or more properties selected from the group consisting of coefficient of thermal expansion, melting point, electrical conductivity, magnetic coercivity, dielectric constant, thermal conductivity, Young's modulus, hardness, and reflectivity.

25. The structure described in claim 23 wherein said physical properties that are exceptions are selected from the group consisting of electrical conductivity, magnetic coercivity, dielectric constant, hardness, and reflectivity.

26. A structure, comprising:

a continuous body, having a first part possessing a first set of physical properties, wherein said first part is a soft magnet; and a second part having a second set of physical properties that are the same as said first set of physical properties with at least one exception, wherein said second part is non-magnetic;

said first and second parts having any shape that can be formed by a molding process.

* * * * *